US006456268B1

(12) United States Patent
Takeda

(10) Patent No.: US 6,456,268 B1
(45) Date of Patent: Sep. 24, 2002

(54) ACTIVE MATRIX TYPE LIQUID CRYSTAL DISPLAY DRIVE CONTROL APPARATUS

(75) Inventor: Hiroshi Takeda, Tokyo (JP)

(73) Assignee: NEC Corporation, Tokyo (JP)

( * ) Notice: Subject to any disclaimer, the term of this patent is extended or adjusted under 35 U.S.C. 154(b) by 110 days.

(21) Appl. No.: 09/609,254

(22) Filed: Jun. 30, 2000

(30) Foreign Application Priority Data

Jul. 2, 1999 (JP) ..... 11-188611

(51) Int. Cl.[7] ..... G09G 3/36

(52) U.S. Cl. ..... 345/92; 345/95; 345/100; 345/210; 345/204; 349/42

(58) Field of Search ..... 345/87–104, 209–210, 345/204–206; 349/42, 46, 47

(56) References Cited

U.S. PATENT DOCUMENTS 4,779,085 A * 10/1988 Mizutome et al. ..... 340/805
4,804,951 A * 2/1989 Yamashita et al. ..... 340/719
5,434,599 A * 7/1995 Hirai et al. ..... 345/100

FOREIGN PATENT DOCUMENTS

| | | | |
|---|---|---|---|
| JP | 3-146992 | 6/1991 | |
| JP | 5-108032 | 4/1993 | ..... G09G/3/36 |
| JP | 7-199152 | 8/1995 | |
| JP | 11-3061 | 1/1999 | |

* cited by examiner

*Primary Examiner*—Lun-Yi Lao
(74) *Attorney, Agent, or Firm*—Foley & Lardner

(57) ABSTRACT

By setting a gate voltage for each of the horizontal sync frequency bands, the flicker is reduced in a display mode of a low horizontal sync frequency. A drive control apparatus 10 includes: a frequency detection circuit 12 for detecting a horizontal sync frequency h; a gate-on voltage changing circuit 16 for changing a gate-on voltage Vg of a TFT 14 for liquid crystal drive, according to the horizontal sync frequency h detected by the frequency detection circuit 12; and a common voltage changing circuit 20 for changing a common voltage Vc of a liquid crystal 18 according to the horizontal sync frequency h detected by the frequency detection circuit 12.

7 Claims, 6 Drawing Sheets

*FIG.3 (A)*

| No. | HORIZONTAL SYN FREQUENCY [KHz] | CONTROL SIGNAL | | |
|---|---|---|---|---|
| | | A | B | C |
| 1 | 0 ~ 15 | 1 | 0 | 0 |
| 2 | 15 ~ 30 | 0 | 1 | 1 |
| 3 | 30 ~ 45 | 0 | 1 | 0 |
| 4 | 45 ~ 60 | 0 | 0 | 1 |
| 5 | 60 ~ | 0 | 0 | 0 |

*FIG.3 (B)*

| No. | CONTROL SIGNAL | | | GATE-ON VOLTAGE | COMMON VOLTAGE |
|---|---|---|---|---|---|
| | A | B | C | | |
| 1 | 1 | 0 | 0 | Vg5 | Vc1 |
| 2 | 0 | 1 | 1 | Vg4 | Vc2 |
| 3 | 0 | 1 | 0 | Vg3 | Vc3 |
| 4 | 0 | 0 | 1 | Vg2 | Vc4 |
| 5 | 0 | 0 | 0 | Vg1 | Vc5 |

$$\left(\begin{array}{l} Vg1>Vg2>Vg3>Vg4>Vg5 \\ Vc1>Vc2>Vc3>Vc4>Vc5 \end{array}\right)$$

*FIG. 6*

| No. | HORIZONTAL SYNC FREQUENCY (KHz) | CONTROL SIGNAL | | | | | |
|---|---|---|---|---|---|---|---|
| | | A | B | C | D | E | F |
| 1 | ~ 15.000 | 1 | 1 | 1 | 1 | 1 | 1 |
| 2 | 15.000 ~ 17.813 | 1 | 1 | 0 | 1 | 0 | 1 |
| 3 | 17.813 ~ 20.625 | 1 | 0 | 1 | 1 | 1 | 0 |
| 4 | 20.625 ~ 23.438 | 1 | 0 | 1 | 0 | 0 | 0 |
| 5 | 23.438 ~ 26.250 | 1 | 0 | 0 | 1 | 0 | 0 |
| 6 | 26.250 ~ 29.063 | 0 | 1 | 1 | 1 | 1 | 0 |
| 7 | 29.063 ~ 31.875 | 0 | 1 | 1 | 0 | 1 | 1 |
| 8 | 31.875 ~ 34.688 | 0 | 1 | 1 | 0 | 0 | 1 |
| 9 | 34.688 ~ 37.500 | 0 | 1 | 0 | 1 | 1 | 1 |
| 10 | 37.500 ~ 40.313 | 0 | 1 | 0 | 1 | 1 | 0 |
| 11 | 40.313 ~ 43.125 | 0 | 1 | 0 | 1 | 0 | 0 |
| 12 | 43.125 ~ 45.938 | 0 | 1 | 0 | 0 | 1 | 1 |
| 13 | 45.938 ~ 51.563 | 0 | 1 | 0 | 0 | 1 | 0 |
| 14 | 51.563 ~ 54.375 | 0 | 1 | 0 | 0 | 0 | 1 |
| 15 | 54.375 ~ 57.188 | 0 | 1 | 0 | 0 | 0 | 0 |
| 16 | 57.188 ~ | 0 | 0 | 1 | 1 | 1 | 1 |

ACTIVE MATRIX TYPE LIQUID CRYSTAL DISPLAY DRIVE CONTROL APPARATUS

BACKGROUND OF THE INVENTION

1. Field of the Invention

The present invention relates to an active matrix type liquid crystal display using a thin film transistor (hereinafter, referred to as a TFT) and in particular, to a drive control apparatus of the active matrix type liquid crystal display.

2. Description of the Related Art

The currently wide-spread TFT is an n-channel MIS (metal insulator semiconductor) transistor constituting of amorphous silicon and poly silicon. In a liquid crystal, in order to prevent deterioration due to a DC component, a positive polarity voltage Vd (0 to Vdmax) and a negative polarity voltage −Vd(0 to Vdmax) are alternately applied. The TFT turns on if a gate voltage Vg greater than a threshold value is applied and the TFT turns off if a gate voltage smaller than the threshold value is applied.

Recently, the active matrix type liquid crystal display is expected to have a multi sync and smaller dots for monitor. Here, the multi sync is to display a video signal having different drive frequencies or resolutions. However, when multi sync and smaller dots are obtained, a horizontal sync frequency becomes higher, which in turn shortens the gate on time of the TFT for the liquid crystal drive. This reduces the time for writing a video signal into the liquid crystal. Accordingly, when writing a positive polarity voltage near the gate on voltage, the writing cannot be completed in time. As a result, a DC component is applied to the negative polarity side, deteriorating the liquid crystal.

In order to solve this problem, Japanese Patent Publication 5-108032 discloses a liquid crystal drive method in which the positive polarity voltage and the negative polarity voltage of a video signal to be applied to the liquid crystal are not set evenly for a common voltage but the positive polarity voltage is increased according to one horizontal period for transferring a display data of a horizontal line. Thus, when a frame frequency is made faster or when a selection period of a horizontal line is reduced because of the increased number of display lines, it is possible to drive without applying a DC component to the liquid crystal.

However, a complicated configuration is required to increase the positive polarity voltage while leaving the negative voltage as it is. It is difficult to realize such a configuration only by adding a certain circuit to an existing source driver. The source driver is a circuit for applying a positive polarity voltage and a negative polarity voltage constituting a video signal to a drain of the TFT.

SUMMARY OF THE INVENTION

It is therefore an object of the present invention to provide an active matrix type liquid crystal display drive control apparatus which can prevent, with a simple configuration, generation of a DC component of a voltage applied to a liquid crystal when the horizontal sync frequency is increased.

The drive control apparatus according to the present invention is used for an active matrix type liquid crystal display comprising: a first substrate having display pixel electrodes and thin film transistors (TFT), each arranged at one of orthogonal intersections of a plurality of gate lines and a plurality of drain lines, wherein sources of the TFT are connected to the display pixel electrodes, and a second substrate having a common electrode and arranged so as to oppose to the first substrate via a liquid crystal layer. The drive control apparatus according to the present invention comprises: a frequency detection circuit for detecting a horizontal sync frequency, a gate-on voltage changing circuit for hanging a gate-on voltage of the TFT according to the horizontal sync frequency detected by the frequency detection circuit, and a common voltage changing circuit for changing a common voltage of the common electrode according to the horizontal sync frequency detected by the frequency detection circuit.

Hereinafter, explanation will be given on the function of the present invention in case that the TFT is an n-channel transistor.

If the horizontal sync frequency is low, it is possible to assure a sufficient gate-on time for the TFT. However, if the horizontal sync frequency becomes higher and the TFT gate-on time becomes shorter, the voltage applied to the liquid crystal is insufficient when a positive polarity voltage is applied to the TFT drain. As a result, a DC component is applied to the liquid crystal.

To cope with this, in the present invention, the TFT gate-on voltage is changed according to the horizontal sync frequency. That is, as the horizontal sync frequency is increased, the gate-on voltage is increased. In other words, as the horizontal sync frequency is lowered, the gate-on voltage is lowered. This increases the drain current and it is possible to obtain a sufficient voltage for application to the liquid crystal even when a positive polarity voltage is applied to the TFT drain.

However, as the gate-on voltage is increased, the feed through voltage is also increased proportionally. The feed through is a phenomenon that the voltage applied to the liquid crystal is shifted to the negative polarity voltage when the TFT is turned off from the on state. If the feed through voltage becomes great, there arises a problem that a remarkable flicker occurs.

To cope with this, in this invention, the common voltage of the liquid crystal is changed according to the horizontal sync frequency. That is, as the horizontal sync frequency is increased, the common voltage is decreased. In other words, as the horizontal sync frequency becomes lower, the common voltage is made higher. Here, the gate-on voltage when a positive polarity voltage is applied to the drain of the TFT may be made higher than when a negative polarity voltage is applied to the drain and the difference between them may be increased as the horizontal sync frequency is increased. Since the voltage applied to the liquid crystal is a difference between the source voltage and the common voltage, lowering of the common voltage increases the positive polarity voltage applied to the liquid crystal and lowers the negative polarity voltage (absolute value) applied to the liquid crystal. This eliminates the affect of the feed through voltage generated when the gate-on voltage is increased and accordingly, eliminates a DC component of the voltage applied to the liquid crystal.

Here, the configuration for changing the TFT gate-on voltage according to the horizontal sync frequency only changes the voltage supplied to a gate driver and can be realized only by adding a simple circuit to the existing gate driver. The gate driver is a circuit for applying gate-on voltage as a scan signal to the TFT on horizontal line basis. Moreover, the configuration for changing the common voltage according to the horizontal sync frequency only changes a voltage supplied to the existing common electrode of the liquid crystal and can be realized only by adding a simple circuit.

Moreover, if the TFT is a p-channel transistor, it turns on when a negative polarity voltage is applied to the gate. Accordingly, as the horizontal sync frequency becomes higher, the gate-on voltage is lowered and the common voltage is increased. In other words, as the horizontal sync frequency is lowered, the gate-on voltage is increased and the common voltage is lowered. Here, the gate-on voltage when a negative polarity voltage is applied to the drain of the TFT may be lowered than the gate-on voltage when a positive polarity voltage is applied to the drain and the difference between them may be increased as the horizontal sync frequency is increased.

BRIEF DESCRIPTION OF THE DRAWINGS

FIG. 3(A) is a table showing operation of the frequency detection circuit and FIG. 3(B) is a table showing operation of a gate-on voltage changing circuit and a common voltage changing circuit.

FIG. 6 is a table showing an operation example of a frequency detection circuit in the drive control apparatus of FIG. 5.

DESCRIPTION OF THE PREFERRED EMBODIMENTS

Figure 1:
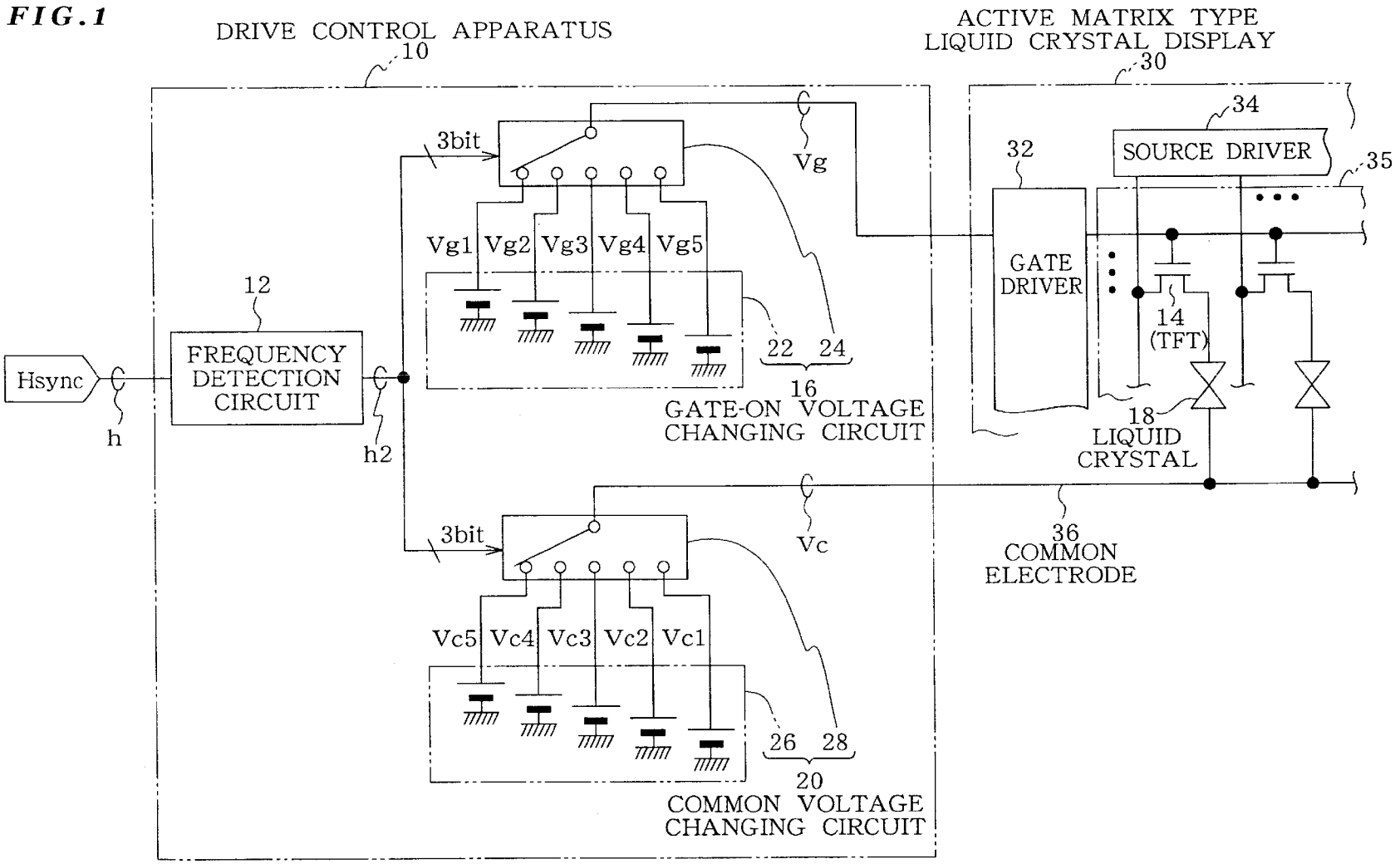
FIG. 1 is a block diagram showing a drive control apparatus according to a first embodiment of the present invention.
Figure 2:
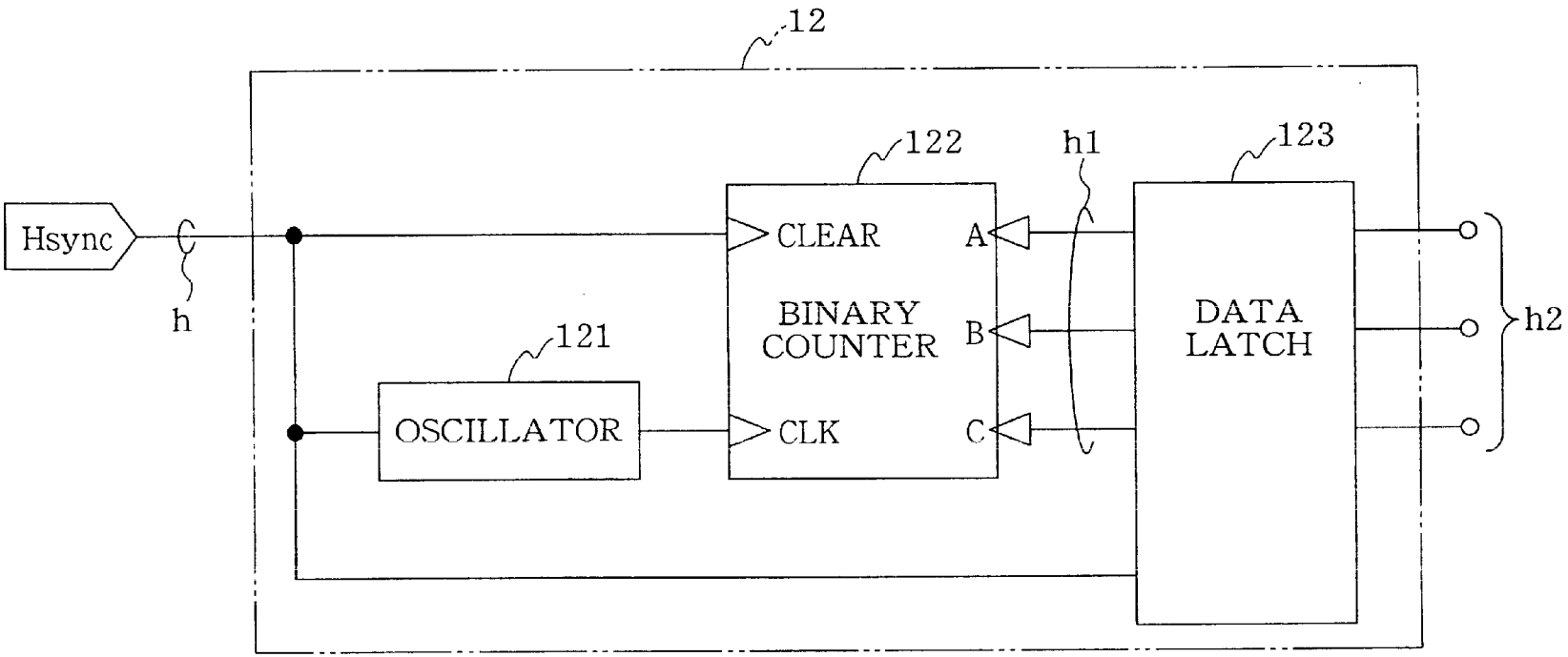
FIG. 2 is a block diagram showing an example of a frequency detection circuit in the drive control apparatus of FIG. 1.

FIG. 1 is a block diagram showing a drive control apparatus according to a first embodiment of the present invention. FIG. 2 is a block diagram showing an example of a frequency determination circuit in the drive control apparatus of FIG. 1. Hereinafter, explanation will be given with reference to these figures.

The drive control apparatus 10 according to the first embodiment includes: a frequency detection circuit 12 for detecting a horizontal sync frequency h; a gate-on voltage changing circuit 16 for changing the gate-on voltage Vg of the TFT 14 for driving the liquid crystal according to the horizontal sync frequency h detected by the frequency detection circuit 12; and a common voltage changing circuit 20 for changing a common voltage Vc of the liquid crystal panel 18 according to the horizontal sync frequency h detected by the frequency detection circuit 12.

The gate-on voltage changing circuit 16 is constituted by a gate-on voltage generator 22 for generating five voltage values Vg1 to Vg5 and a gate-on voltage selector switch 24 for selecting for output one of the voltage values Vg1 to Vg5 generated by the gate-on voltage generator 22. The common voltage changing circuit 20 is constituted by a common voltage generator 26 for generating five voltage values Vc1 to Vc5 and a common voltage selector switch 28 for selecting for output one of the voltage values Vc1 to Vc5.

An active matrix type liquid crystal display 30 is a multi sync type including a gate driver 32 for outputting a scan signal, a source driver 34 for outputting a video signal, and a liquid crystal panel 35. The liquid crystal panel 35 is constituted by a liquid crystal material sandwiched by a first and a second substrate (not depicted). The first substrate has a number of segment electrodes arranged in rows and columns. The segment electrodes are display pixel electrodes each connected to the TFT 14. On the other hand, the second substrate has a single common electrode 36 common to all the display pixels. The TFT 14 is an n-channel MIS transistor made from amorphous silicon.

The frequency detection circuit 12 includes an oscillator 121, a binary counter 122, and a data latch 123. The oscillator 121 generates a clock signal synchronized with a horizontal sync signal for sampling a horizontal sync signal and outputs the clock signal to the binary counter 122. The binary counter 122 uses the horizontal sync signal as a reset signal and repeatedly outputs a binary signal hi as a clock signal counting result at a cycle of the horizontal sync signal. The data latch 123 latches a maximum value of the binary signal h1 produced from the binary counter 122, at a cycle of the horizontal sync signal and outputs the maximum value as a control signal h2. That is, as the horizontal sync frequency h increases, the value of the control signal h2 decreases. Thus, the frequency detection circuit 12 outputs a control signal h2 corresponding to the horizontal sync frequency h.

FIG. 3 is a table showing an operation example of the drive control apparatus 10. Hereinafter, explanation will be given on the operation of the drive control apparatus 10 with reference to FIG. 1 to FIG. 3.

Since the active matrix type liquid crystal display 30 is of the multi sync type, the horizontal sync frequency h is assumed to change between 15 and 16 [kHz] and the output frequency of the oscillator 121 is set to 60 [kHz]. As shown in FIG. 3(A), the frequency detection circuit 12 outputs five types of 3-bit control signals h2 according to the horizontal sync frequency h.

On the other hand, as shown in FIG. 3(B), the gate on voltage selector switch 24 selects one of the voltage values Vg1 to Vg5 according to the control signal h2 and outputs it as a gate-on voltage Vg to the gate driver 32. Moreover, as shown in FIG. 3(B), the common voltage selector switch 28 selects one of the voltage values Vc1 to Vc5 according to the control signal h2 and outputs it as a common voltage Vc to the common electrode 36. It should be noted that the voltage values Vg1 to Vg5 satisfy the relationship: Vg1>Vg2>Vg3>Vg4>Vg5; and the voltage values Vc1 to Vc5 satisfy the relationship: Vc1>Vc2>Vc3>Vc4>Vc5. This switch operation can be realized by employing, for example, an analog switch for the gate-on voltage selector switch 24. and the common voltage selector switch 28.

Thus, in the drive control apparatus 10, as the horizontal sync frequency h is increased, the gate-on voltage Vg is increased and the common voltage Vc is lowered. As the gate-on voltage Vg is increased with the increase of the horizontal sync frequency h, the drain current of the TFT 14 is increased. Accordingly, it is possible to obtain a sufficient voltage to be applied to the liquid crystal even when a positive polarity voltage is applied to the drain of the TFT 14. Moreover, since the common voltage Vc is lowered as the horizontal sync frequency h is increased, it is possible to eliminate affect of a feed through voltage caused by increase of the gate-on voltage Vg and to eliminate a DC component of the voltage applied to the liquid crystal.

Moreover, the configuration for changing the gate-on voltage Vg according to the horizontal sync frequency h only changes the voltage supplied to the gate driver 32 and can be realized by adding a simple circuit to the existing gate driver 32. Moreover, the configuration for changing the common voltage Vc according to the horizontal sync frequency h only changes the voltage supplied to the existing common electrode 36 and can be realized by adding a simple circuit.

Next, a detailed explanation will be given on the reason how such an effect is generated.

The electric charge q applied to the liquid crystal can be obtained by Equation (1) given below, the current Id (t) flowing into the liquid crystal can be obtained by Equation (2) given below, and voltage Vg (t) applied to the TFT gate can be obtained by Equation (3) given below.

$$q=\int_0^T Id(t)dt \quad (1)$$

$$Id(t)=(W/L)\cdot \mathrm{Cox}\cdot\mu\cdot(Vg(t)-Vdc-Vth) \quad (2)$$

$$Vg(t)=Vg(1-\exp(-T/\tau)) \quad (3)$$

wherein q: electric charge applied to the liquid crystal

Id (t): current flowing into the liquid crystal

W: channel width

L: channel length

Cox: gate insulation film capacity $\mu$: carrier mobility

Vg (t): voltage applied to the gate

Vdc: center voltage of the drain voltage

Vth: threshold level

Vg: gate-on voltage

T: gate-on time $\tau$: gate line time constant

Here, the relationship between the electric charge q applied to the liquid crystal, the gate-on time T, and the gate-on voltage Vg can be obtained from Equations (1) to (3) as follows by Equation (4).

$$q^4\ \mathrm{Vg}(1-\exp(-T/\tau)) \quad (4)$$

From Equation (4), when the gate-on time T is increased, the identical electric charge q can be applied to the liquid crystal even if the gate-on voltage Vg is decreased.

Next, the relationship between the feed through voltage ΔVf and the gate-on voltage Vg is shown by Equation 5 given below.

$$\Delta Vf=Vg(Cgs/(Cgs+C1c+Cst)) \quad (5)$$

wherein

ΔVf: feed through voltage

Cgs: parasitic capacity between the gate and the source

C1c: liquid crystal capacity of a pixel

Cst: accumulative capacity

Equation (5) shows that the feed through voltage Δ Vf is proportional to the gate-on voltage Vg.

In this embodiment, the gate-on voltage is modified for each of the horizontal sync frequency bands and, judging from Equation (5), the feed through voltage differs between the horizontal sync frequency bands. When modifying the gate-on voltage for each of the horizontal sync frequency bands, the common voltage is modified in synchronization. This enables to reduce the flicker than in the conventional example when a video signal having a low horizontal sync frequency is input. It should be noted that for a video signal having a lower horizontal frequency, it takes a longer time until the voltage applied to the liquid crystal is reversed and the flicker is more remarkable.

Figure 4:
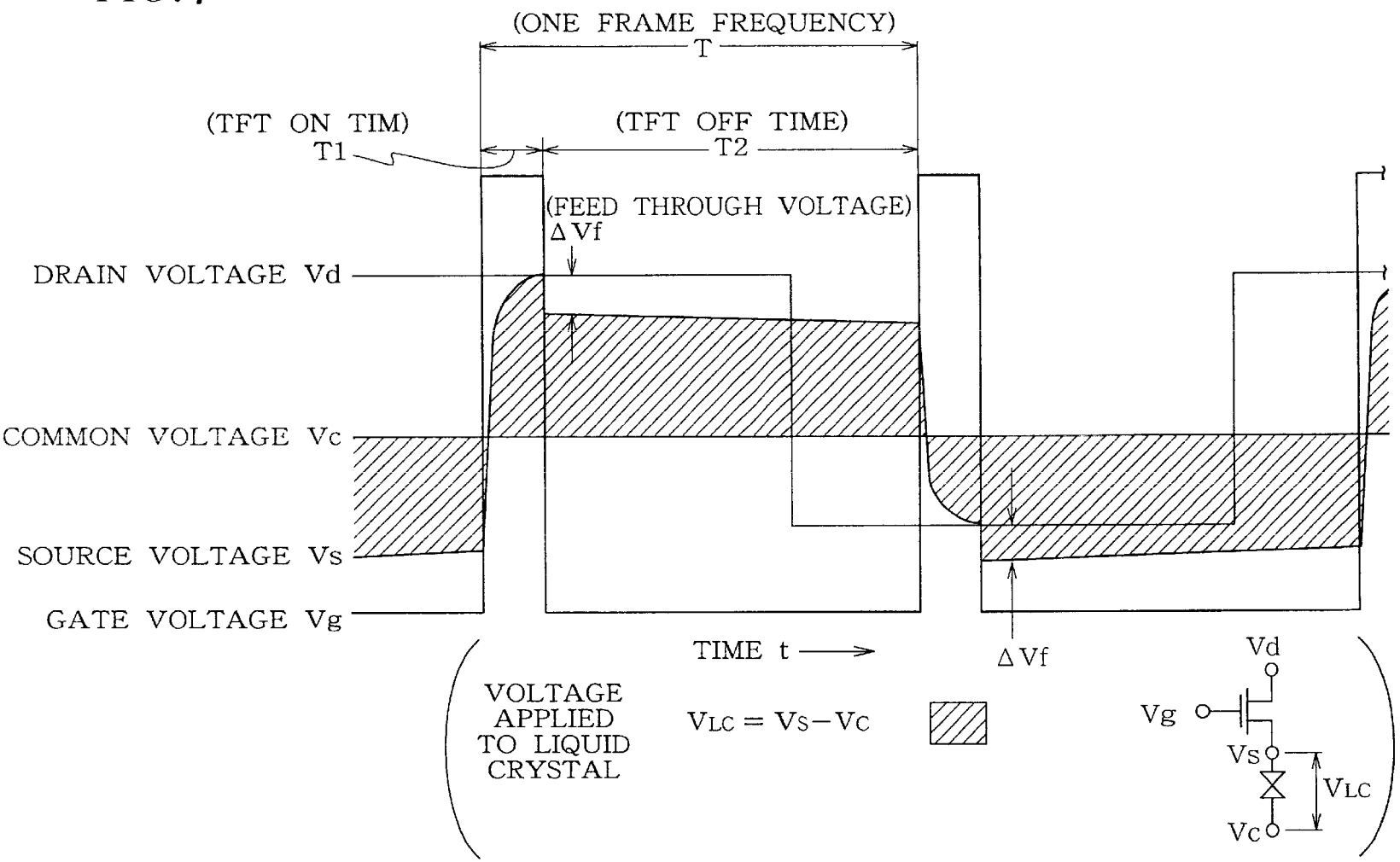
FIG. 4 shows a waveform showing an example of voltage applied to the liquid crystal in the operation of the drive control apparatus of FIG. 1.
Figure 5:
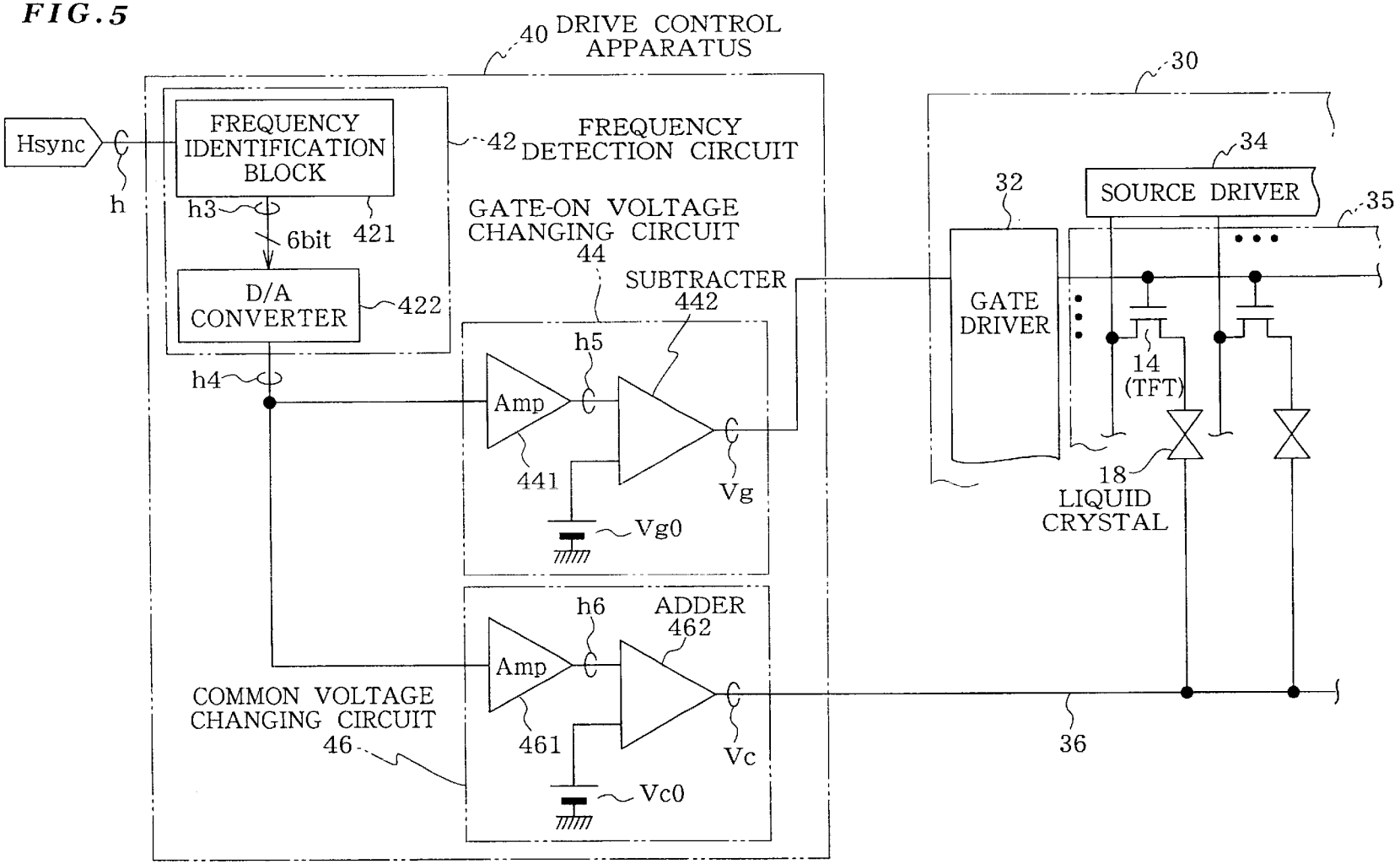
FIG. 5 is a block diagram showing a drive control apparatus according to a second embodiment of the present invention.

FIG. 4 shows a waveform example of the voltage applied to the liquid crystal in the present embodiment. FIG. 5 is a block diagram showing a drive control apparatus according to a second embodiment of the present invention. FIG. 6 is a table showing an operation example of the frequency detection circuit in the drive control apparatus of FIG. 5. Hereinafter, explanation will be given with reference to these figures. Like components are denoted by like reference symbols and their explanations are omitted.

The drive control apparatus 40 of the second embodiment includes: a frequency detection circuit 42 for detecting a horizontal sync frequency h; a gate-on voltage changing circuit 44 for changing the gate-on voltage Vg of the TFT 14 for driving the liquid crystal; and a common voltage changing circuit 46 for changing the common voltage Vc of the liquid crystal 18 according to the horizontal sync frequency h detected by the frequency The frequency detection circuit 42 includes a frequency detector 421 having a configuration almost identical to the frequency identification circuit 12 of FIG. 1 and a D/A converter 422 for converting a 6-bit control signal h3 output from the frequency detector 421, into an analog voltage control signal h4. The gate-on voltage changing circuit 44 includes a an amplifier 441 for amplifying the control signal h4 and a subtracter 422 for subtracting the control signal h5 which has been amplified by the amplifier 441, from a reference voltage VgO and outputting the result as the gate-on voltage Vg. The common voltage changing circuit 46 includes an amplifier 461 for amplifying the control signal h4 and an adder 462 for adding the control signal 6 which has been amplified by the amplifier 461, to the reference voltage Vc0 and outputting the result as the common voltage Vc.

Next, explanation will be given on the operation of the drive control apparatus 40.

If the oscillator of the frequency detector 421 has an output frequency of 957 [kHz] and the horizontal sync frequency h band is 15 to 60 [LkHz], as shown in FIG. 6, the control signal h3 becomes 6-bit data and the horizontal sync frequency h has '16' divisions. The D/A converter 422 converts the control signal h3 into the analog voltage control signal h4 for output to the amplifiers 441 and 461. The amplifier 441 amplifies the control signal h4 so as to match the correction amount of the gate-on voltage Vg and outputs the amplified signal as a control signal h5. The amplifier 461 amplifies the control signal h4 so as to match a correction amount of the common voltage Vc and outputs the amplified signal as a control signal h6. The subtracter 442 subtracts the control signal h5 from the reference voltage Vg0 and outputs the result to the gate driver 32. The adder 462 adds the control signal h 6 to the reference voltage Vc0 and outputs the result to the common electrode 36.

Thus, in the drive control apparatus 40, as the horizontal sync frequency h is increased, the gate-on voltage Vg is increased and the common voltage Vc is lowered. By increasing the gate-on voltage Vg as the horizontal sync frequency h is increased, the drain current of the TFT 14 is increased. Accordingly, it is possible to obtain a sufficient voltage to be applied to the liquid crystal even when a positive polarity voltage is applied to the drain of the TFT 14. Moreover, by lowering the common voltage Vc as the horizontal sync frequency h is increased, it is possible to eliminate the affect of the feed through voltage when the gate-on voltage is increased and to eliminate a DC component of the voltage to be applied to the liquid crystal.

The second embodiment has following merits over the first embodiment. Since there is no need of providing a plurality of power sources for the gate-on voltage Vg and the common voltage Vc, it is possible to reduce the circuit size. Moreover, the gate-on voltage Vg and the common voltage Vc is switched between 16 grades according to the horizontal sync frequency h and accordingly, it is possible to display a high-quality image.

In the drive control apparatus according to the present invention, by changing the gate-on voltage of the TFT and the common voltage according to the horizontal sync frequency, it is possible to eliminate a DC component of the voltage caused by a feed through voltage when applied to the liquid crystal. Accordingly, it is possible to suppress deterioration of the liquid crystal and realize a video image without flicker. Moreover, the configuration for changing the gate-on voltage according to the horizontal sync frequency can be realized only by adding a circuit for changing the voltage supplied to the existing gate driver. Moreover, the configuration for changing the common voltage according to the horizontal sync frequency can be realized only by adding a simple circuit for changing the voltage applied to the existing common electrode.

Lastly, the drive control apparatus according to the present invention will be explained again using other words.

A gate-on voltage is set so as to enable writing of the entire positive polarity voltage even if display is performed with the maximum operation frequency in the multi sync. However, as the gate-on voltage is increased, the feed through voltage is also increased, causing a problem of remarkable flicker. Here, in a display mode lower than the maximum operation frequency, voltage can be sufficiently written into the liquid crystal even if the gate-on voltage is set to a voltage smaller than that of the maximum operation frequency display mode. Accordingly, if it is possible to reduce the gate-on voltage when the horizontal sync frequency is low, it is possible to reduce the feed through voltage than when display is performed with the maximum operation frequency, enabling to reduce the flicker.

In other words, in the active matrix type liquid crystal display with multi sync according to the present invention, the gate-on voltage is set in such a way that the entire positive polarity voltage can be written. Moreover, in a display mode lower than the maximum operation frequency, by setting a gate-on voltage and a common voltage for each of the horizontal sync frequency bands, it is possible to reduce the feed through voltage and reduce the flicker than in the conventional example.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No.11-188611 (Filed on Jul. 2, 1999) including specification, claims, drawings and summary are incorporated herein by reference in its entirety.

What is claimed is:

1. An active matrix type liquid crystal display drive control apparatus for an active matrix type liquid crystal display comprising:

a first substrate having display pixel electrodes and thin film transistors, each arranged at one of orthogonal intersections of a plurality of gate lines and a plurality of drain lines, wherein sources of the thin film transistors are connected to the display pixel electrodes, and a second substrate having a common electrode and arranged so as to oppose to the first substrate via a liquid crystal layer, the drive control apparatus comprising:

a frequency detection circuit for detecting a horizontal sync frequency, a gate-on voltage changing circuit for changing a gate-on voltage of the thin film transistors according to the horizontal sync frequency detected by the frequency detection circuit, and a common voltage changing circuit for changing a common voltage of the common electrode according to the horizontal sync frequency detected by the frequency detection circuit.

2. An active matrix type liquid crystal display drive control apparatus as claimed in claim 1, wherein the gate-on voltage changing circuit increases the gate-on voltage as the horizontal sync frequency is increased, and the common voltage changing circuit lowers the common voltage as the horizontal sync frequency is increased.

3. An active matrix type liquid crystal display drive apparatus as claimed in claim 2, wherein the gate-on voltage when applying a positive polarity voltage to the drain of the thin film transistor is set higher than the gate-on voltage when applying a negative polarity voltage to the drain and a difference between these gate-on voltages is increased as the horizontal frequency is increased.

4. An active matrix type liquid crystal display drive apparatus as claimed in claim 2, wherein the common voltage changing circuit lowers the common voltage as the horizontal sync frequency is increased, so as to cancel the feed through voltage.

5. An active matrix type liquid crystal display drive apparatus as claimed in claim 1, wherein the gate-on voltage changing circuit lowers the gate-on voltage as the horizontal sync frequency is increased, and the common voltage changing circuit increases the common voltage as the horizontal sync frequency is increased.

6. An active matrix type liquid crystal display drive apparatus as claimed in claim 5, wherein the gate-on voltage when applying a positive polarity voltage to the drain of the thin film transistor is set higher than the gate-on voltage when applying a negative polarity voltage to the drain and a difference between these gate-on voltages is increased as the horizontal frequency is increased.

7. An active matrix type liquid crystal display drive apparatus as claimed in claim 5, wherein the common voltage changing circuit lowers the common voltage as the horizontal sync frequency is increased, so as to cancel the feed through voltage.

* * * * *